US008047396B2

(12) United States Patent
Jenkins et al.

(10) Patent No.: US 8,047,396 B2
(45) Date of Patent: Nov. 1, 2011

(54) END BOSS AND COMPOSITE PRESSURE VESSEL

(75) Inventors: Peter Jenkins, Nesbru (NO); Svein Are Lotveit, Nesbru (NO); Gunnar Axelsson, Langhus (NO)

(73) Assignee: Compressed Energy Technology AS, Oslo (NO)

( * ) Notice: Subject to any disclaimer, the term of this patent is extended or adjusted under 35 U.S.C. 154(b) by 86 days.

(21) Appl. No.: 12/664,352

(22) PCT Filed: Jun. 13, 2008

(86) PCT No.: PCT/NO2008/000214

§ 371 (c)(1),
(2), (4) Date: Feb. 18, 2010

(87) PCT Pub. No.: WO2008/153414

PCT Pub. Date: Dec. 18, 2008

(65) Prior Publication Data

US 2010/0181325 A1 Jul. 22, 2010

(30) Foreign Application Priority Data

Jun. 14, 2007 (NO) ..... 20073034

(51) Int. Cl.
*F17C 1/02* (2006.01)

(52) U.S. Cl. ..... 220/586; 220/581

(58) Field of Classification Search ..... 220/581, 220/582, 586–590

See application file for complete search history.

(56) References Cited

U.S. PATENT DOCUMENTS

| | | | | |
|---|---|---|---|---|
| 5,287,988 | A | 2/1994 | Murray | |
| 5,938,209 | A | 8/1999 | Sirosh et al. | |
| 7,861,887 | B2 * | 1/2011 | Ota et al. | 220/581 |

FOREIGN PATENT DOCUMENTS

| | | | |
|---|---|---|---|
| WO | WO-94/23240 | A1 | 10/1994 |
| WO | WO-01/31252 | A1 | 5/2001 |
| WO | WO-03/069217 | A1 | 8/2003 |
| WO | WO-2005/093313 | A1 | 10/2005 |
| WO | WO-2007/085276 | A1 | 8/2007 |

* cited by examiner

*Primary Examiner* — Harry Grosso

(74) *Attorney, Agent, or Firm* — Birch, Stewart, Kolasch & Birch, LLP

(57) ABSTRACT

A composite pressure vessel comprised of an inner fluid tight liner and an outer reinforced polymer layer. An end boss comprising a short pipe section arranged through an opening of the vessel and extending to a lower end with an outwardly extending flange on the pipe section arranged between the outer layer and the inner liner, and a lid arranged at an upper end of the pipe section. The inner liner extends upwards through the opening of the pipe section to the lid with at least one gas tight seal interfacing against the inner liner. A pre-tensioning device is arranged on the outside of the inner liner, in a groove nearest to the lid and pipe section, around the upper end of the pipe section, which, regardless of the pressure in the vessel, presses the inner liner against the at least one gas tight seal.

10 Claims, 2 Drawing Sheets

END BOSS AND COMPOSITE PRESSURE VESSEL

FIELD OF THE INVENTION

Figure 1:
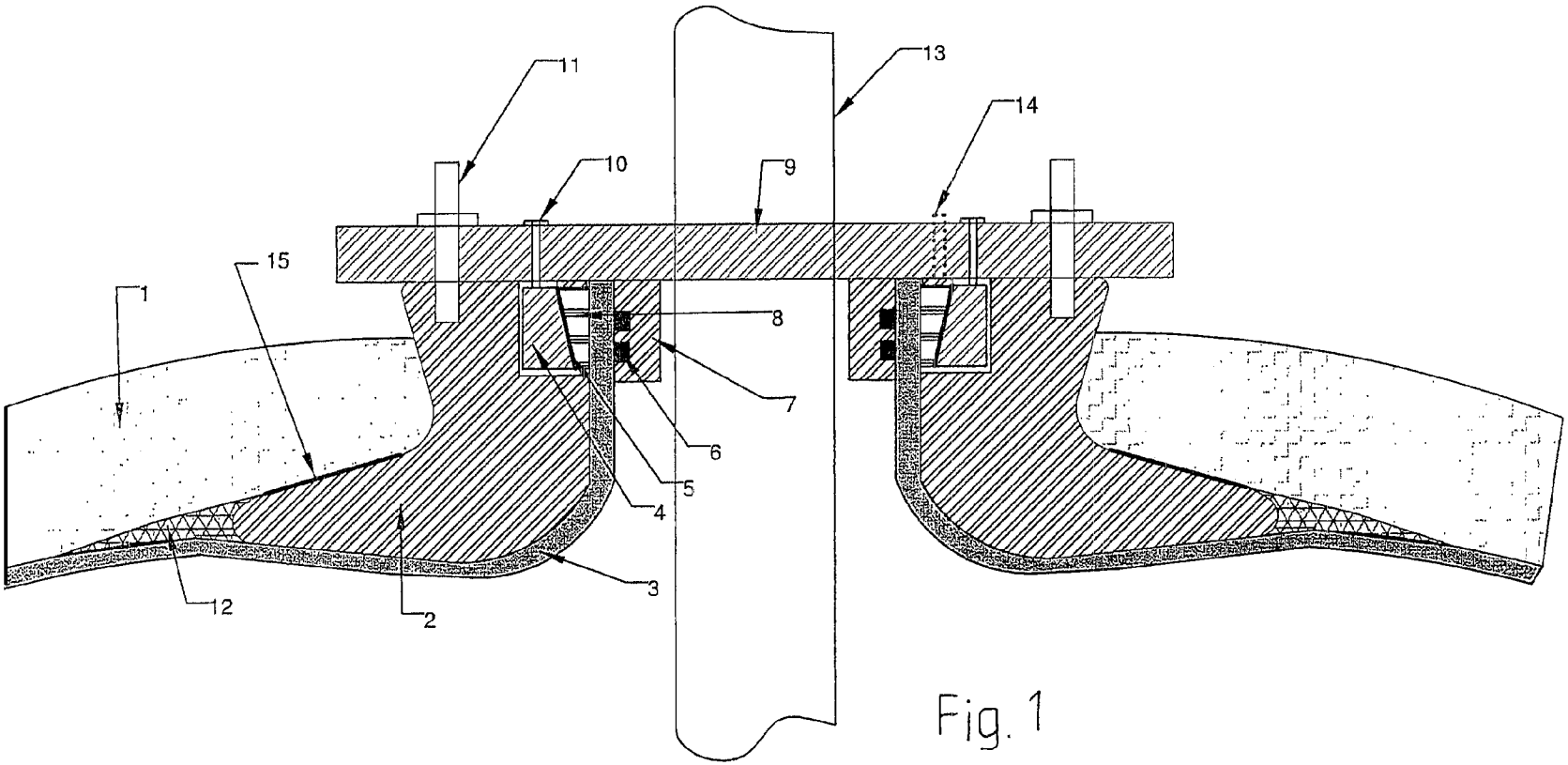

The current invention relates to composite pressure vessels for the storing of compressed natural gas and other fluids. More precisely, the invention relates to an end boss, which is a termination end for use in vessels of to said type and a composite pressure vessel equipped with such end boss.

BACKGROUND OF THE INVENTION AND PRIOR ART

In recent years the use of composite pressure vessel to manage hydrocarbons under high pressure has become more current. Such vessels should preferably be usable for a broad spectre of hydrocarbons, from dry, compressed natural gas, so-called CNG, to unprocessed well fluids from oil production. Well fluids would typically be an oil based liquid under pressure, containing compressed gas as well as pollution in the form of water, sand, $H_2S$, $CO_2$, etc. In order to make optimal use of the storing facility for the pressure vessel, dry gas is stored at low temperatures since this increases the compressibility of the gas, whilst the well fluids would typically have a high temperature from the reservoir. It is advantageous to maintain a high temperature for the well fluids in order to avoid problems with hydrate formation inside the pressure vessel and connecting pipe systems. In order to make optimal use of the storing volume onboard a vessel, it is advantageous to use large vessels, typically cylindrical vessels with a diameter greater than 2 meters and the height or length greater than 10 meters.

Composite pressure vessels comprises an inner liner produced from thermo plastic, such as high density polythene, HDPE or from hardened polymer materials, for example of the epoxy type. The inner liner acts as gas/fluid barrier in the vessel. Outside the inner liner, there is a composite layer maintaining the pressure inside the vessel, which is typically produced from filament of glass fibre or carbon fibre, wound with pretension on the vessels inner liner and embedded in a polymer material, for example of the epoxy type. At one end or both ends of the composite pressure vessel, there is an end boss, typically of metal and which is held in place by the composite structure. The metal end boss makes it simple to arrange feed-throughs for loading and unloading of the vessel and provides an entry into the vessel. For vessels with a broader use as mentioned above, the design and connecting of the end boss provide a significant challenge. The metal end boss has a significantly lower thermal expansion than polymer and composite materials, resulting in problems at prolonged use with large temperature and pressure variations. At high temperature the inner plastic liner will expand more than the metal end boss, resulting in tension build-up at the contact surface between the inner liner and the end boss. Due to the viscoelastic properties of polymer materials, prolonged use at high temperature will result in tension relief over time. When the pressure and temperature are later reduced, the inner liner will contract more than the end boss, resulting in that over time a gap is created in the contact interface between the inner polymer liner and end boss.

Patent publications WO 2005/093313, U.S. Pat. No. 5,938,209, WO 94/23240 and U.S. Pat. No. 5,287,988, describe different end boss constructions and sealing arrangements between the end boss and composite pressure vessel. Described are seal rings of elastic polymer material, constructions with an elastomer O-ring for sealing; and constructions where the inner polymer liner is moulded around and to an end boss having a rough surface. There is not a description of constructions where the inner liner is pressed against an inner metal counter pressure hold by means of pre-tensioning arrangement placed outside the inner polymer liner. Neither is there a description of a pre-tensioning arrangement, which may easily be adjusted should this be required after prolonged use.

There is a need for an end boss for a composite pressure vessel with more advantageous qualities than previously achievable; and a composite pressure vessel with such an end boss.

SUMMARY OF THE INVENTION

The current invention accommodates for the above-mentioned need in that it provides an end boss and a composite pressure vessel.

More precisely, provided for is an end boss arranged in an opening of a composite pressure vessel comprising an inner fluid tight liner and an outer reinforced polymer layer, which end boss comprises a short pipe section and a lid, the lid is arranged at an upper end of the pipe section that extends out from the vessel, the pipe section is arranged through the opening of the vessel and extends to a lower end where an outwardly extending flange on the pipe section is arranged between the outer reinforced polymer layer and the inner liner in the vessel. The end boss is distinguished in that:

the inner liner extends upwards through the opening of the pipe section to said lid, on the inside of the inner liner, in a distance nearest to the lid, a sealing surface is arranged, the sealing surface lies against the inner liner and has at least one gas tight seal interfacing against the inner liner as the sealing surface is integrated with the lid or is a sleeve or a pipe section which is sealingly fastened to the lid, and on the outside of the inner liner, in a groove nearest to the lid and pipe section, around the upper end of the pipe section, a pre-tensioning device is arranged, which regardless of the pressure in the vessel presses the inner liner against said sealing surface and the at least one gas tight seal.

The invention also provides for a composite pressure vessel with an end boss of the above mentioned type arranged, in that the composite pressure vessel has a design and distinction as described in claim 9.

The term a fluid tight liner refers to a barrier for fluid such as gas and liquid, for example of polythene or other mainly, fluid tight material.

The term pipe section and sleeve refer not only to cylindrical versions of such elements, but also to conical elements, gradually narrowing elements or in other ways non-cylindrical elements with shape adjusted according to the intention.

The groove for the pre-tensioning device has a depth large enough for the inner liner to always be sealingly arranged between the sealing surface and the pretension device, for the entire range of use for the vessel in relation to pressure and temperature. Consequently, the inner liner will always be pressed together between the sealing surface on the inside of the inner liner and the pretension device on the outside of the inner liner; as the inner liner will never contract more than it may still extend well within at least one gas tight seal and the lid. The inner liner will normally not be bonded to neither the end boss nor the outer fibre reinforced polymer layer; and will freely contract and expand so that the end of the inner liner will always be between the lid and the at least one gas tight seal.

The metal boss has advantageously a pretension device having adjustable pretension; the pretension can most advantageously be adjusted from outside of the vessel. The pretension device comprises advantageously an outer wedge shaped metal ring arranged with the wedge facing the lid, and an inner oppositely directed wedge shaped polymer ring arranged between the outer metal ring and the inner liner; as the outer metal ring is secured to bolts carried through the lid so that the pretension may be adjusted by tightening the bolts; whereby the outer metal ring is brought closer to the lid and presses the polymer ring against the inner liner. In an advantageous execution the pretension device comprises a polymer ring, which is higher than the groove so that when the lid is tightly fastened, the polymer ring is pressed against the inner liner. The polymer ring may be chosen from many polymers and elastomers and is in an advantageous execution, of the same material as the inner liner, for example HDPE, which is particularly advantageous for inner liner with a high elongation at rupture, meaning over 20% elongation at rupture. For inner liner with low elongation at rupture, under 20% elongation at rupture, a pretension device comprising wedges will work best.

The pretension device may have many different designs. One can use wedge shaped rings, springs, elastomers and adjustment devices in many different configurations, designs and material, given that the function of the pretension device is maintained. In an execution an inner wedge shaped polymer ring is fixedly fastened to the outside of the inner liner and an elastomer layer is arranged between the inner polymer ring and an outer metal ring. Alternatively are two wedge shaped rings in the pretension device turned in relation to the above mentioned, so that the outer ring may be pressed downwards from the lid, by means of adjusting screws, for so in order to adjust the pretension. In other executions, the pretension comprises one or several springs, which spring effect may be directly adjusted by adjusting screws; or indirectly by means of a wedge shaped outer ring. In other executions, a large elastomer O-ring, or a V-ring within an outer wedge shaped ring or ring shaped spring is used.

The lid of the end boss is advantageously of metal and the sealing surface is advantageously the outer surface of a metal sleeve, which is sealingly fastened to the lid. In an execution, the lid and the sealing surface are of composite material, produced as one integral unit. Alternatively, the lid is of metal and the sealing surface is of polymer or composite structure.

At least two gas tight seal is advantageously arranged in the contact surface against the inner liner, preferably in the form of lip seals, but in principal all types of gas tight seals allowing for some movements between the seals and the inner liner, for example C-rings and O-rings, may be used.

The sealing surface on the inside of the inner liner is advantageously ring shaped and is preferably the outer surface of a metal ring, which is sealingly fastened to the lid, for example with bolts or welding. The metal ring has preferably a slight conical lower end, below the sealing surface, for easier joining and fastening of the lid.

FIGURES

The current invention is illustrated by two figures, where

Figure 2:
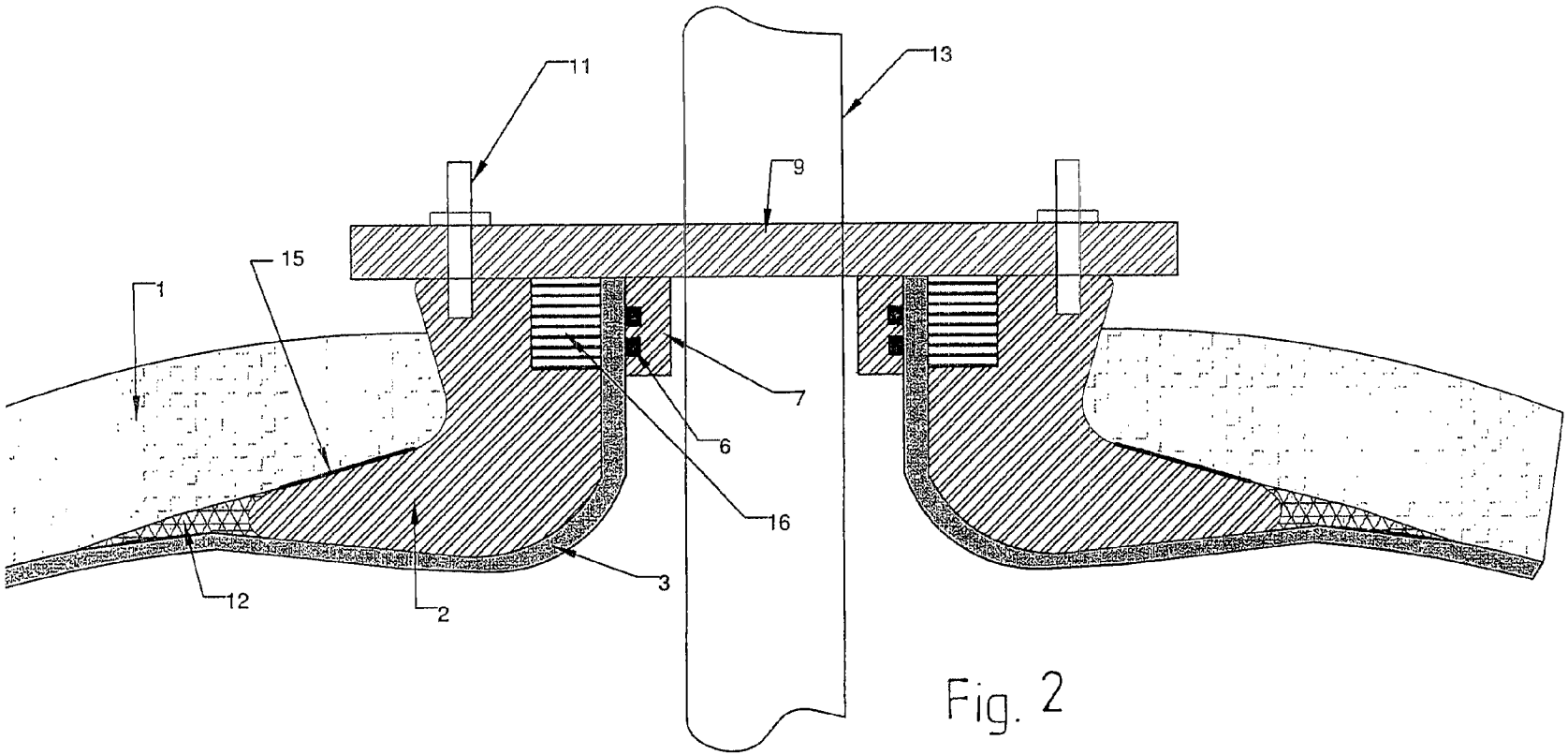

FIG. 1 illustrates the most preferred execution form of an end boss and a composite pressure vessel in accordance with the current invention; for inner liner with low elongation at rupture; and FIG. 2 illustrates a different execution of an end boss and a composite pressure vessel in accordance with the current invention, particularly advantageous for inner liner with high elongation at rupture.

DETAILED DESCRIPTION

With reference to FIG. 1, illustrated is a metal end boss 2,9 (metal boss) arranged in an opening in a composite pressure vessel comprising an inner fluid tight liner 3 and an outer fibre reinforced polymer layer 1. The metal boss comprises a short pipe section 2 and a lid 9, in that the lid is arranged on the upper end of the pipe section 2, which extends out of the vessel. The pipe section 2 is arranged through the opening in the vessel and extends to a lower end where an outwardly extending flange on the pipe section is arranged between the outer fibre reinforced polymer layer 1 and the inner liner 3 in the vessel so that the pipe section remains fastened to the vessel. The inner liner 3 extends upwards through the opening of the pipe section to the said lid. Inside of the inner liner, at a distance nearest the lid, is arranged a sealing surface 7 in the form of a metal surface 7 interfacing the inner liner. In a groove on the metal surface 7, two gas tight seals 6 are arranged on contact surface against the inner liner. The metal surface is integrated with the lid or is a metal sleeve, metal ring or pipe section, which is fastened sealingly to the lid. Outside of the inner liner, at a distance nearest to the lid in a groove in the upper end of the pipe section; immediately outside and around the inner liner 3, a pretension device 4, 8, 10 is arranged, which device presses the inner liner 3 against said metal surface and the said gas tight seals 6.

The flange part of the pipe section of the boss is as such held in place between the vessels inner liner 3 and the outer fibre reinforced polymer layer 1. The pipe section is closed with a lid 9, which is held in place by means of bolts 11. The inner liner 3 is arranged on the inside of the composite structure 1, and a composite ring 12 around the circumference of flange part creates an even transition for the liner 3 from the inside of the composite structure 1 to inside pipe section 2. The liner 3 is neither fastened to the composite structure 1 or the pipe section 2. An interlay 15 of elastomer is arranged on the top of the flange structure to avoid concentration of tension in the polymer layer 1 when the vessel is put under pressure. A pipe 13 is brought through the lid of the vessel 9 on top of the pipe section 2, for filling and emptying of the vessel. The metal surface 7 is in the form of a metal ring 7, which extends a distance into the opening of the pipe section and is sealingly fastened to the lid 9. In order to secure the sealing of the gas and fluids for the pressure in the vessel, a good seal between the inner liner 3 and the metal boss is necessary. The seal is formed between the metal surface 7 and the liner 3. Two spring tensioned lip seals 6 are arranged in a groove in the metal surface 7. The lip seals 6 provide a long-lasting constant gas tight seal between the liner 3 and the metal surface 7 and allows for relative movement between the liner 3 and the metal surface 7 during operations with large variations in pressure and temperature inside the pressure vessel. The seal between the inner liner 3 and the metal ring 7 is pretensioned or activated by means of a special pretension device in form of wedge shaped rings or ring segments. The wedge shaped rings consist of a polymer ring 8 in a wedge shape and a metal ring 4 in a wedge shape; where the metal ring has the wedge upwards against the lid 9 and the polymer ring has the wedge down towards against the inner of the vessel. An interlay of, rubber 5 may preferentially be arranged between said rings; and bolts 10 are fastened to the metal ring 4 and brought through the lid 9. The tightening of the bolts 10 activates the sealing device. When the bolts are tightened, the wedge shaped metal ring 4 is pressed up against the lid. This presses the wedge shaped polymer ring 8 against the inner liner so that the inner liner 3 is maintained pressed against the metal ring 7 and the seals 6. The intention with using a wedge shaped polymer ring 8 is that it will have the equivalent temperature expansion coefficient as the inner polymer liner 3. The wedge shaped polymer ring will therefore follow the temperature deformations of the inner liner, which is advantageous for a vast operational area in relation to temperature and pressure of the inner liner. The rubber interlay 5 arranged between the wedge shaped ring 4 of metal and the wedge shape ring 8 of polymer material, functions as a spring mechanism in the seal and secures that the pressure from the two wedge shaped rings on the inner liner 3 is nearly constantly independent of the temperature for the inner liner 3. The space around the wedge shaped rings is ventilated 14 to avoid accumulation of gas pressure by possible gas diffusion through the two lip seals 6.

A composite pressure vessel with end boss in accordance with the current invention will be suitable for a wide range of use with relation to pressure and temperature. The use of a wedge shaped ring 8 of polymer material provides a seal with similar deformation in the ring direction as for the inner liner 3 of polymer material. This provides a particularly efficient sealing mechanism through a large temperature range. The illustrated pretension device is elastically tensioned and allows the inner liner 3 to expand and contract when exposed to temperature variation. A rubber interlay 5 between the wedge shaped metal ring and the wedge shaped polymer ring contributes to said effect, but such effect can also be achieved by using bolts with springs or with underlying suspension discs in a ring shaped arrangement of bolts, which can be tightened by adjusting the pretension effect. Alternatively; or in addition, elastomer O-rings can be arranged in grooves in wedge shaped rings, or a large O-ring; or ring shaped spring, which may have adjustable pretension, for example by means of bolts fed through the lid, can be arranged.

The composite ring 12 is a glass fibre ring, which provides an even transition for the inner liner 3 from inside of the metal boss 2 to the outer fibre reinforced polymer layer 1. This prevents concentration of stress. Equivalent arrangement to prevent concentration of stress by providing an even transition from the inner liner may be produced from other material than glass fibre. An important feature with the current invention is that the pretension device, which allows large variation of temperature and pressure to the inner liner 3, is independent of the pressure in the vessel. The pressure, which works on the lid 9 is absorbed by large bolts 11, screwed into the pipe section 2. The illustrated execution may however, be viewed as having a certain self adjusting effect in relation to the pretension, in that a possible deformation of the lid due to high pressure in the vessel, would lead to further tightening of the pretension since the bolts are fastened in against the lid 9.

FIG. 2 illustrates a second execution of an end boss and a composite pressure vessel in accordance with the current invention; particularly advantageous for inner liners with high elongation at rupture. The pretension device comprises a polymer ring 16, which is higher than the groove, for example 0.5-5% higher than the groove, so that the lid, which is tightly fastened, would press the pretension device against the inner liner. The polymer ring 16 advantageously has same or similar temperature expansion coefficient as the inner liner; most preferred is the polymer ring and the inner liner of the same material.

The invention claimed is:

1. End boss (2,9) arranged in an opening of a composite pressure vessel comprising an inner fluid tight liner (3) and an outer reinforced polymer layer (1), which end boss comprises a short pipe section (2) and a lid (9), the lid is arranged at an upper end of the pipe section (2) that extends out from the vessel, the pipe section (2) is arranged through the opening of the vessel and extends to a lower end where an outwardly extending flange on the pipe section is arranged between the outer reinforced polymer layer (1) and the inner liner (3) in the vessel, characterized in that the inner liner (3) extends upwards through the opening of the pipe section to said lid, on the inside of the inner liner, in a distance nearest to the lid, a sealing surface is arranged, the sealing surface lies against the inner liner and has at least one gas tight seal interfacing against the inner liner as the sealing surface is integrated with the lid or is a sleeve or a pipe section which is sealingly fastened to the lid, and on the outside of the inner liner, in a groove nearest to the lid and pipe section, around the upper end of the pipe section, a pre-tensioning device is arranged (4, 8, 10, 16), which regardless of the pressure in the vessel presses the inner liner (3) against said sealing surface and the at least one gas tight seal (6).

2. End boss in accordance with claim 1, characterized in that the pre-tensioning device (4, 8, 10) has an adjustable tension.

3. End boss in accordance with claim 1, characterized in that the tension of the pre-tensioning device (4, 8, 10) can be adjusted externally from the pressure vessel, by adjusting bolts (10) from outside of the lid (9).

4. End boss in accordance with claim 1, characterized in that the pre-tensioning device comprises an outer wedge-shaped metal ring (4) positioned with the wedge up against the lid, and an inner oppositely orientated wedge-shaped polymer ring (8) positioned between the outer metal ring (4) and the inner liner (3), the outer metal ring is secured to bolts (10) extending through the lid, so that the pre-tensioning may be adjusted by tightening the bolts (10), whereby the outer metal ring (4) is brought closer to the lid (9) and presses the polymer ring (8) against the inner liner.

5. End boss in accordance with claim 1, characterized in that the pre-tensioning device comprises a polymer ring (16) which is higher than the groove, so that when the lid (9) is tightly fastened the polymer ring (16) is pressed against the inner liner (3).

6. End boss in accordance with claim 5, characterized in that the polymer ring (16) is of the same material as the inner liner (3).

7. End boss in accordance with claim 1, characterized in that the lid (9) is of metal and the sealing surface (7) is the outer surface of a metal sleeve which is sealingly fastened to the lid.

8. End boss in accordance with claim 1, characterized in that the lid (9) and the sealing surface (7) are of composite material produced as an integral unit.

9. Composite pressure vessel comprising an inner fluid tight liner (3) and an outer reinforced polymer layer (1), characterized in that the pressure vessel comprises an opening where an end boss comprising a short pipe section (2) and a lid (9) is arranged, the lid (9) is arranged at the upper end of the pipe section (2) that extends outwards from the vessel, the pipe section (2) is arranged through the opening of the vessel and extends to a lower end where an outwardly extending flange on the pipe section is arranged between the outer fibre reinforced polymer layer (1) and the inner liner (3) in the vessel, the inner liner (3) extends upwards through the opening of the pipe section to said lid, on the inside of the inner liner, in a distance closest to the lid, a sealing surface (7) is arranged, the sealing surface lies against the inner liner and has at least one gas tight seal (6) interfacing against the inner liner, as the sealing surface is integrated with the lid or is a sleeve or a pipe section that is sealingly fastened to the lid, and on the outside of the inner liner in a groove nearest to the lid and pipe section, around the upper end of the pipe section, a pre-tensioning device is arranged (4, 8, 10, 16), which regardless of the pressure inside the vessel presses the inner liner (3) against said sealing surface and the at least one gas tight seal (6).

10. Composite pressure vessel in accordance with claim 9, characterized in that the pre-tensioning device (4, 18, 10) has an adjustable (10) tension.

* * * * *